US005590917A

United States Patent [19]

Brooks et al.

[11] Patent Number: 5,590,917

[45] Date of Patent: Jan. 7, 1997

[54] HIGH SECURITY PUSH-TO-EXIT PEDESTRIAN DOOR CONTROL

[75] Inventors: Harold L. Brooks; Thomas R. Clark, both of Lexington; Kun H. Kim, Louisville, all of Ky.; James W. Overbey, Jeffersonville, Ind.

[73] Assignees: Mas-Hamilton Group, Lexington; N T Monarch Hardware, Shepardsville, both of Ky.

[21] Appl. No.: 527,659

[22] Filed: Sep. 13, 1995

[51] Int. Cl.[6] ..... E05C 9/10

[52] U.S. Cl. ..... 292/21; 292/92; 70/92

[58] Field of Search ..... 292/92, DIG. 62, 292/21; 70/DIG. 42, DIG. 71, 92, 107, 156, 284, 465

[56] References Cited

U.S. PATENT DOCUMENTS

| | | | |
|---|---|---|---|
| 2,541,723 | 2/1951 | Shaw et al. | 70/146 |
| 3,875,772 | 4/1975 | Ebersman et al. | 70/107 |
| 4,961,330 | 10/1990 | Evans | 292/21 |
| 4,978,151 | 12/1990 | Coleman et al. | 292/21 |

OTHER PUBLICATIONS

NT Monarch Hardware 18 Series Exit Devices—Parts Manual, Feb. 1993.

*Primary Examiner*—Steven N. Meyers
*Assistant Examiner*—Donald J. Lecher
*Attorney, Agent, or Firm*—Laurence R. Letson

[57] ABSTRACT

A combination lock/deadbolt is connected to a push-to-open panic-bar device to operate in response to push-bar operation, thereby withdrawing both the push-bar latchbolt and the deadbolt permitting instantaneous and unrestricted egress from a secured area. To maintain the security of the area from unauthorized entry from outside the secured area, a connection between the push-to-open device and the combination lock/deadbolt assembly is implemented with a lost motion connection. The lost motion device, preferably is a flexible cable transmitting force only in tension, assures that any operation of the combination lock/deadbolt will not effect the security provided by the push-to-open device. Further, the push-to-open device may be provided both with a conventional key cylinder lock and a knob, ever, or thumb lever release on the door exterior. Opening action initiated from outside the door through the knob lever or thumb lever release is mechanically segregated from the cable connection to the combination lock/deadbolt, preventing operation of the push-to-open device from the outside causing operation of the combination lock/deadbolt assembly. Accordingly, an authorized individual must have both a key for the key cylinder lock and the authorized combination for the combination lock in order to gain entry to the secured area, yet anyone may exit the secured area without any restrictions or delay merely by pushing the push-to-open bar.

5 Claims, 3 Drawing Sheets

HIGH SECURITY PUSH-TO-EXIT PEDESTRIAN DOOR CONTROL

FIELD OF THE INVENTION

This invention relates to securing devices used on pedestrian doors, in pedestrian passages, and more particularly to the inter-connection of a panic-bar device with a combination lock controlled deadbolt device to permit unrestricted egress from a room without a separate operation of the deadbolt mechanism.

BACKGROUND OF THE INVENTION

High security environments exist wherein the area to be secured is essentially a room within a building. Typically, ingress into the secured area is by a pedestrian door. The overall security of the secured area depends upon the door staying in a locked condition by a highly secure lock at all times whenever the pedestrian door is not open.

Whenever a combination lock/deadbolt lock such as a Mas-Hamilton Group CDX-07 is used to provide the security to the pedestrian passage, the security against unauthorized entry is highly effective; however, the deadbolt does not permit ready egress in emergency situations. Both the deadbolt must be manually retracted by turning a knob and the door latch operated, usually necessitating a two-handed operation to open the door from the inside. In circumstances where an emergency requires unimpeded egress, such as a fire or toxic gas leak, it is undesirable to require the use of two hands, and two motions to operate the securing devices in order to exit the secured area through the pedestrian passage. Some regulatory agencies and states require the securing devices on at least some doors be operable with only a single motion.

Additionally, it is desirable to provide a method permitting egress from the secured area through the pedestrian passage without the need to grasp any device, such as a knob, handle, or lever. It is common to install a push-to-open door latch device for such situations. Such a device also is commonly referred to as a panic-bar or panic-bar device. A panic-bar device is operated by a force pushing on the bar or touch bar which then activates and withdraws the latchbolt which had secured the door in its closed position.

Seeking to exit a room in an emergency, the natural action of a person is to extend a hand and push on the door to cause it to swing outward. Doors for emergency exits are required by fire, safety, or building codes to open outwardly, not to obstruct egress in an emergency. Even if the person trying to exit in an emergency situation reached toward the push-bar or panic-bar device and missed it, other body actions such as by hip pressure usually will be adequate to cause the panic-bar device to operate to withdraw the latchbolt which is holding the door in its secured condition.

However, wherever a deadbolt lock of the Mas-Hamilton Group CDX-07 type is used to render the enclosure highly secure, operation of the panic-bar device will not permit opening the pedestrian door without the use of a hand to operate the knob controlling the deadbolt withdrawal. The CDX-07 deadbolt lock and similar locks include a combination dial lock which provides the locking function while the deadbolt portion permits the door to be closed and the deadbolt extended to secure the door. The combination lock must be operated to withdraw the deadbolt from outside the door of the secured area.

A prior attempt to solve this severe problem was the panic-bar exit used with the Sergeant and Greenleaf Model 8470 combination lock/deadbolt. This device is described in Walter R. Evans U.S. Pat. No. 4,961,330.

A panic-bar mechanism of a different design is manufactured and sold by NT Monarch Hardware under a designation of Push-Bar Series 18 Exit Devices. Such push-bar devices are available from NT Monarch Hardware of Shepherdsville, Ky. 40165. While the NT Monarch Push-Bar Exit Devices are very adequate for maintaining a door in a latched position and permitting emergency egress, the operation of the panic-bar still is incapable of operating a combination lock with a deadbolt such as the Mas-Hamilton CDX-07.

The panic-bar of Walter R. Evans, described in U.S. Pat. No. 4,961,330, is operated from the interior by pushing the push-bar which acting through a rigid linkage operates the deadbolt to withdraw the bolt. Ingress to the secured area is accomplished by dialing and operating the combination lock to withdraw the deadbolt and by operating a device, such as an electronic lock control, to provide a signal to further operate the panic-bar latch thereby withdrawing the latchbolt. The electronic signal controlled panic-bar latch control is disposed to pull the latchbolt but relies on a one-way drive connection in the chain of elements between the push-bar and the latchbolt to withdraw the latchbolt but not to effect the chain of elements activated by push bar operation that could act to withdraw the deadbolt.

OBJECTS OF THE INVENTION

It is an object of the instant invention to isolate the operation of a manual opening device operative to withdraw the push-bar latchbolt from an associated deadbolt.

It is another object of the invention to interconnect a deadbolt lock with a panic-bar device so that operation of the combination lock will not operate the panic-bar device.

It is a further object of the invention to interconnect the panic-bar device with a deadbolt lock so that operation of the panic-bar from within the secure area will withdraw the deadbolt from an extended position.

A still further object of the invention is to interconnect the panic-bar device to the deadbolt and lock so that the operation of the panic-bar from outside the secured area will not operate the combination and deadbolt.

SUMMARY OF THE INVENTION

This invention is an improvement and modification to the NT Monarch 18 Series Exit Devices permitting the panic-bar device to be cooperatively connected to a modified Mas-Hamilton CDX-07 combination lock with deadbolt.

The NT Monarch Exit Device is a system for withdrawing the latchbolt of a push-to-exit device upon either the pushing of the panic-bar or the operation of a handle on the outside of the secure area and the rotation of a shaft extending from the handle into the latch housing.

The operation of the handle members will not act to operate the deadbolt lock. Withdrawal of the latchbolt is effected by pulling the drawbar through operation of the panic-bar mechanism or by the pivoting of the drawbar cams which in turn engage the drawbar and thus withdraw the latchbolt. The panic-bar mechanism includes a pair of pivoted levers, referred to as main cams, pivoted on the frame of the push-bar exit device and engaged with the drawbar cams through a lost motion connection, providing drive in one direction and freedom of movement of the drawbar cams in a second direction. The drawbar cams are moved by operation of the panic-bar or push-bar device and the associated push-bar mechanism. Only one of the drawbar cams is moved by operation of the external handle and the external handle does not move the pivoted levers or main cams. The pivoted levers or main cams displace the drawbar cams only in response to the panic-bar operation.

The modified push-to-exit system further comprises a linkage pivoted coaxially with the pivot of one of the main cams and is keyed or pinned to the main cam so that the movement of the main cam will inevitably pivot the linkage.

Alternatively, the pin-connected linkage and the main cam may be considered to be a single bellcrank. Similarly, the pin-connected linkage by itself also may be considered a bellcrank.

The pivoted linkage further is formed to provide an attachment tab providing a through hole into which a termination device of a flexible cable may be inserted. The termination device should be adjustable relative to the attachment tab.

The flexible cable is extended to the withdrawal wheel of the deadbolt lock and wrapped thereon. The end of the flexible cable is attached to the withdrawal wheel and the tension on the cable will act to rotate the wheel thereby withdrawing the deadbolt.

Because the linkage is only pivotally moved about its pivot axis by the operation of the main cam, the pulling of the cable only will occur whenever the panic-bar is depressed because the operation of the external handle does not function to move the main cam connected or associated with the pivoted linkage. The displacement of a main cam will drive the associated drawbar cam due to a positive interference between the two elements, but the drawbar cam cannot move the main cam because of the lost motion aspect of the connection between the two elements.

By disposing the lost motion connection between the main cam and the drawbar cam, the drive of the cable linkage to the deadbolt lock knob or withdrawal wheel is isolated from operation of the latch from the outside of the secure enclosure. This isolation insures that access to the enclosure through the pedestrian door requires the operation of the combination lock as well as the operation of the door latch from outside the door. The operation of the door latch from the exterior of the enclosure may be controlled additionally by incorporating a secondary lock into the exit device to block or inhibit the operation of the exterior latch handle. Blocking the movement of the exterior latch handle prevents operation of the device from outside the enclosure as a secondary and additional security measure to the security provided by the combination lock/deadbolt.

The cable connection between the linkage and the deadbolt withdrawal knob of the deadbolt lock only transmits operational forces in tension, such as when the linkage is pivoted to pull the cable. The cable transmits the force to the knob on the deadbolt lock and thus operates the deadbolt lock to withdraw the bolt to an unlocked position. However, each time the deadbolt knob is rotated in conjunction with the operation of the combination lock and the deadbolt, the cable will buckle and not transmit sufficient forces to the pivoted linkage to cause the displacement of any parts of the exit device. Accordingly, with no displacement of any parts of the panic-bar device, no withdrawal of the latchbolt will occur as a result of the operation of combination lock and the deadbolt.

Thus a doorknob, a door handle, or thumb latch must be independently operated to gain entry to the door every time the combination lock has been operated to withdraw the deadbolt.

A more complete understanding of the invention may be had from the attached drawings and the detailed description of the invention to follow.

DETAILED DESCRIPTION OF THE PREFERRED EMBODIMENT OF THE BEST MODE CONTEMPLATED BY THE INVENTORS FOR CARRYING OUT THE INVENTION

Figure 1:
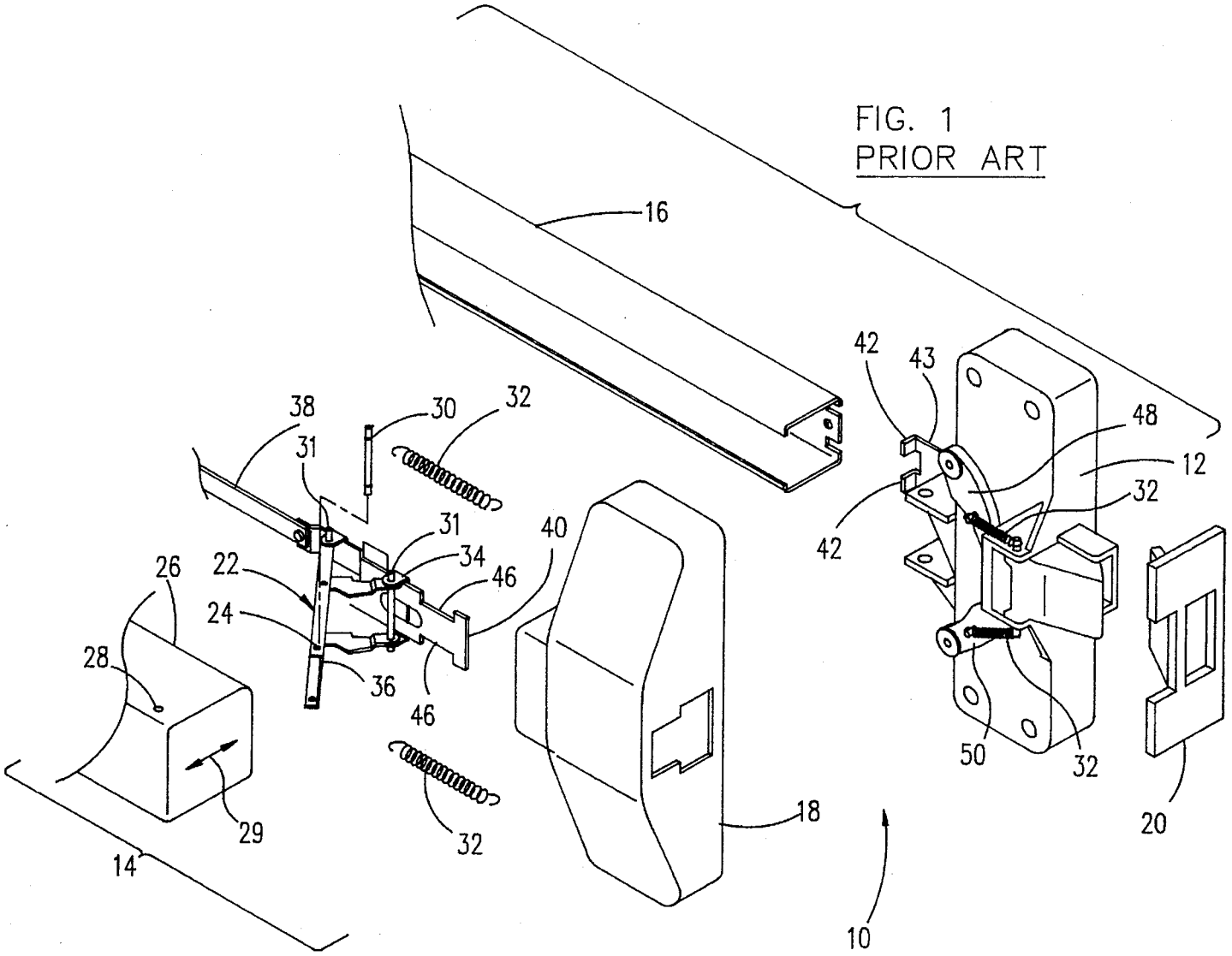
FIG. 1 PRIOR ART
FIG. 1 illustrates an exploded partial view of a prior art push-to-exit device, such as a NT Monarch 18 Series Exit Device, which has been modified in the course of making this invention.
Figure 5:
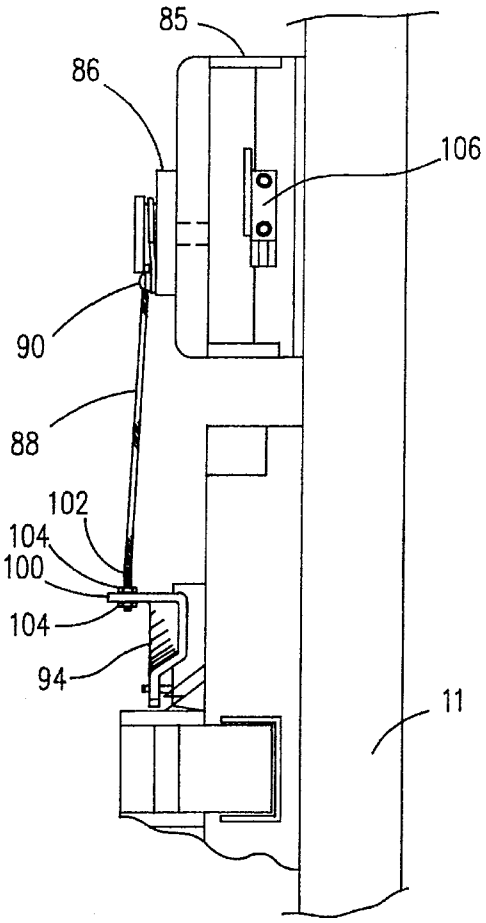
FIGS. 4 and 5 illustrate the modifications to the push-to-exit device that are the subject invention.
Figure 4:
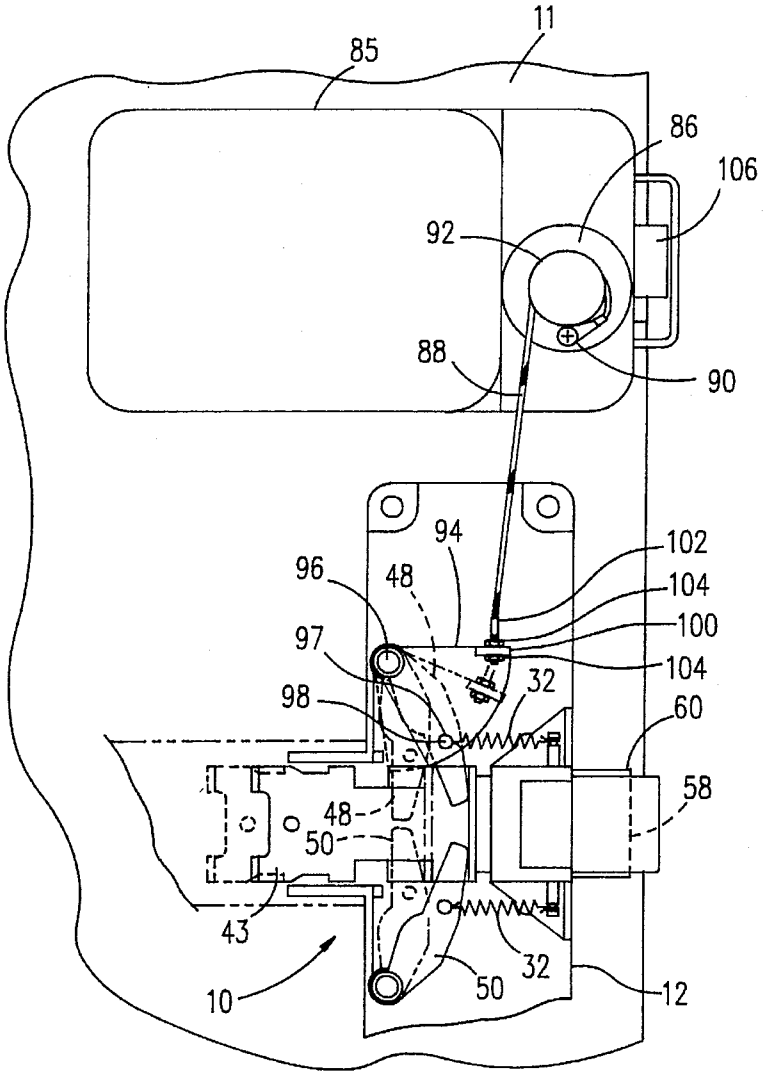

Referring initially to FIG. 1, the push-bar or panic-bar mechanism 10 is partially exploded for visibility. The push-bar mechanism 10 is typically mounted on a door 11 as illustrated in FIGS. 4 and 5. The push-bar mechanism 10 includes a chassis assembly 12, a push-bar sub-assembly 14, a channel 16, cover 18, and strike 20. Scissor assembly 22 is provided with attachment holes 24 for attaching the push-bar 26 at attachment hole 28. Attachment of front scissor assembly 22 to push bar 26 is accomplished with pin 30. Pins 31 are also engaged by springs 32 to provide a return force to the exit device. Scissor bracket 34 is fixedly attached within channel 16 relative to the door. Scissor assembly 22 is attached pivotally to scissor bracket 34 and pivotally attached to connector bar 38. Movement of push-bar 26 toward channel 16 and the door 11, shown in FIGS. 4 and 5, will cause the scissor assembly 22 to flatten or collapse toward the channel 16 and thus push connector bar 38 generally leftward as illustrated in FIG. 1. Connector bar 38 is provided with a T-shaped head 40 which is engagable with tabs 42 of drawbar 43. Notch 46, within which tabs 42 reside, forms a lost motion connection between the drawbar 44 and the connector bar 38.

Figure 2:
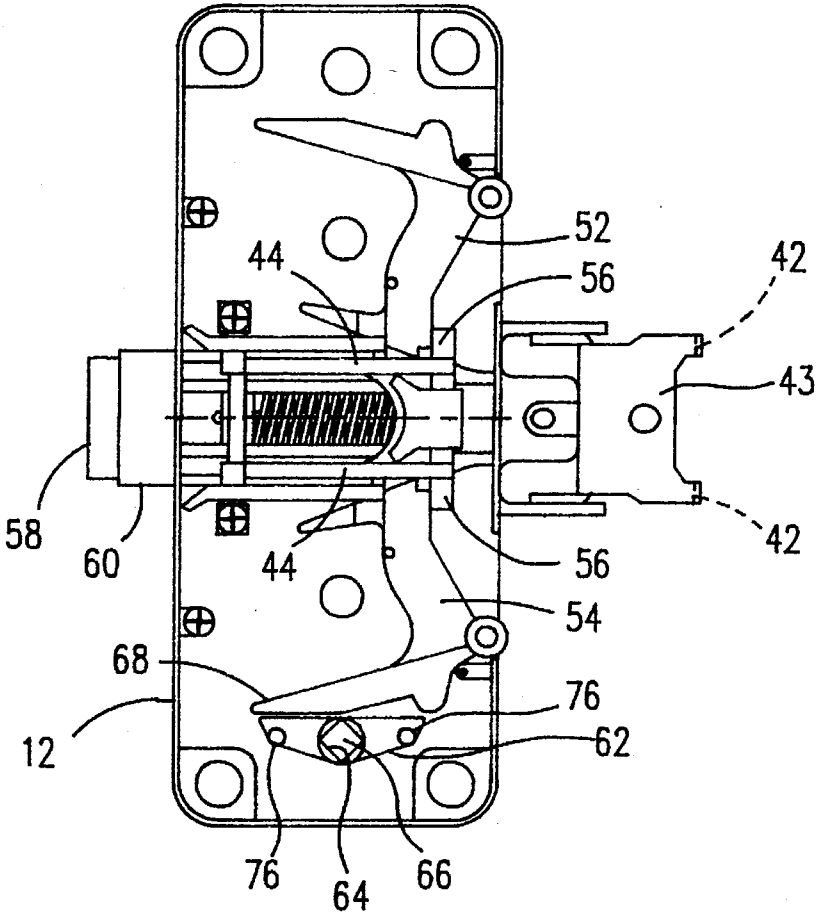
FIG. 2 PRIOR ART
FIG. 2 is a rear view of the mechanism contained within the frame of the prior art push-to-exit device.

Movement of the drawbar 44 in response to depression of the push-bar 26 generally up and to the right as in the direction of arrow 27 as illustrated in FIG. 1, will cause the collapse of scissor arm 36 toward the door (not shown in FIG. 1.) along the direction of arrow 29, will translate connector bar 38 and main cam connector 43 to pivot main cams 48 and 50 in a clockwise and counterclockwise direction respectively. The rotation of main cams 48, 50, due to a post (not shown) extending from the back surface of cams 48 and 50 through chassis 12 will cause the similar rotation of drawbar cams 52 and 54, respectively. Drawbar cams 52 and 54 in FIG. 2 are illustrated from the back of chassis 12. Drawbar cams 52 and 54 are shown engaged with flange 56 of drawbar 44. Drawbar 44 is connected to latchbolt 58 and auxiliary bolt 60. Movement of drawbar 44 in the direction away from chassis 12 will result in the pulling of latchbolt 58 and auxiliary bolt 60 to a withdrawn position to disengage both bolts 58, 60 from strike 20 shown in FIG. 1.

Also illustrated in FIG. 2 is knob hub 62. Knob hub 62 is provided with a square keyway 64 to accept a square shaft 66. Rotation of square shaft 66 by means of a handle or knob on the exterior of a door will cause the similar rotation of knob hub 62. As knob hub 62 rotates in a clockwise direction the knob hub 62 will engage the lower end 68 of drawbar cam 54, causing drawbar cam 54 to rotate clockwise forcing flange 56 generally to the right in FIG. 2 and move drawbar 44 in a rightward direction, thereby retracting latchbolt 58 and auxiliary bolt 60.

If desired, a conventional thumb lever handle (not shown) may be substituted for a knob or handle such that depression of the thumb lever on the outside of the door 11 will cause an engaging member to engage lower end 68 of drawbar cam 54 creating the same action in drawbar cam 54 as was previously described by engagement by knob hub 62.

Figure 3:
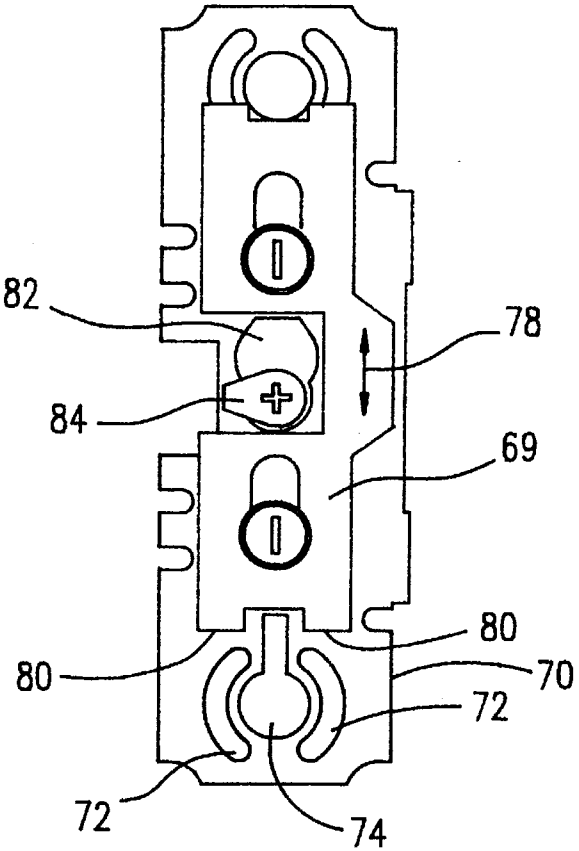
FIG. 3 PRIOR ART
FIG. 3 is an illustration of a prior art locking back plate for the push-to-exit device of FIGS. 1 and 2.

Illustrated in FIG. 3 is a prior art locking plate 69 and back plate 70 which are typically installed between the chassis assembly 12 and the door 11. Back plate 70 is provided with arcuate slots 72 disposed around key-hole shaped opening 74. Slots 72 will accommodate the studs or bosses 76 on knob hub 62 illustrated in FIG. 2. Locking plate 69 may be translated or displaced in the direction of arrow 78 to present the end surfaces 80 of locking plate 69 to studs 76 on knob hub 62. Surfaces 80, when displaced downward in FIG. 3, will engage and prevent the rotation of knob hub 62 effectively locking or disabling the operation of the latch mechanism 10 from the exterior knob handle or thumb lever. Locking plate 69 is translated in the direction of arrow 78 by locking cam 82 which in turn is operated by locking cam operator 84. Locking cam operator 84 is connected to a lock (not shown) which is exposed on the exterior face of the face plate (not shown) on the outside of the door 11. The lock preferably will be a key cylinder lock. Although considerably less secure than that desired in high security environments, when combined with a combination lock, the key cylinder lock forms a highly secure combination of locking elements.

Referring now to FIG. 4, a portion of the chassis 12 of the push-to-open device 10, such as a NT Monarch 18 Series Exit Device, is illustrated along with a combination lock/deadbolt assembly 85 such as the Mas-Hamilton CDX-07. The conventional manually operable knob on the exterior of the deadbolt portion of the Mas-Hamilton CDX-07 is replaced with a cable wheel 86. A cable 88, preferably of wound or braided steel wire, is wrapped around hub 92 on cable wheel 86 and attached to the cable wheel 86 with a screw 90 or similar fastener.

A linkage 94 is provided with a hole 97 to accommodate a preexisting pin 98 extending from main cam 48. Linkage 94 is pivotally mounted on pivot shaft 96 to move with main cam 48. Linkage 94 is further provided with a tab 100. Tab 100 is provided with a hole to accommodate cable termination 102. Cable termination 102 is preferably a threaded rod with a hole formed coaxially within the rod from one end into which cable 88 may be inserted. After insertion of the cable 88, the rod 102 then is swaged to crimp the tubular portion of the rod 102 around cable 88 and thus fix the termination 102 to the cable 88. Cable termination 102 then may be attached to tab 100 by means of nuts 104 threaded onto the threaded portion of cable termination 102 together with any washers (not shown) or similar devices which may be desired. The combination of the two nuts 104 and the threaded termination 102 permit adjustment during assembly or during servicing of the device 10 to insure proper cable length, and a rigid attachment of the cable termination 102 to the tab 100.

As one will appreciate from the understanding of the structure described above, the push-to-open device 10 may be operated either from within the enclosure or secure room or from outside the secure room. If the room is fully secured and deadbolt 106 of the combination lock/deadbolt assembly 85 is fully extended into strike 20, the operation of the push-to-open device 10 alone from outside the enclosure will not render openable the pedestrian door 11. However, when combination lock/deadbolt assembly 85 is appropriately connected to the push-to-open device 10 as illustrated in FIG. 4 and the push-bar 26 as illustrated in FIG. 1 is pushed to cause the retraction of drawbar 44, main cams 48 and 50 will be pivoted to their displaced position in FIG. 4, illustrated in dashed lines. During the translation about their respective pivots, main cams 48 and 50 will engage and similarly pivot drawbar cams 52 and 54 respectively. With drawbar cams 52 and 54 being pivoted, the drawbar 44 will be withdrawn to retract latchbolt 58 and auxiliary bolt 60. As main cam connector 43 pulls main cam 48 about its pivot 96, pin 98 extending through hole 97 in linkage 94 will cause linkage 94 to be pivoted in a clockwise direction. With cable termination 102 tightly and rigidly clamped to linkage tab 100, the movement of the linkage 94 will be transferred to cable 88 causing a resulting counter-clockwise rotation of cable wheel 86.

Cable wheel 86 is conventionally connected to the mechanism interior to the combination lock/deadbolt assembly 85 to cause the withdrawal of deadbolt 106 to a retracted position.

Thus, it can be seen that depression of the push-bar 26 through the chain of linkages described not only will act to withdraw the latchbolt 58 and auxiliary bolt 60 but also the deadbolt 106, thereby permitting immediate and unrestricted egress from the secured area.

To operate the securing devices in order to gain entry to the secured area, it is necessary to operate the combination lock in a conventional manner to cause the withdrawal of deadbolt 106. Due to the linkage interconnecting deadbolt 106 and the cable wheel 86, the cable wheel 86 will rotate in a counter-clockwise direction upon the operation of the combination lock/deadbolt assembly 85. Due to the lack of any significant columnar strength in cable 88, cable 88 will buckle and not transmit any force from cable wheel 86 to any other element or part of the push-to-open device 10.

Accordingly the operation of combination lock/deadbolt 85 will have no effect on the latching function of the push-to-open device 10. In order to gain access to the secured area, knob hub 62 must be rotated by square shaft 66. Knob hub 62 will cause the pivoting of drawbar cam 54 to further cause the withdrawal of drawbar 44 and consequently the withdrawal of latchbolt 58 and auxiliary bolt 60. With latchbolt 58, auxiliary bolt 60 and deadbolt 106 withdrawn, the door 11 may be opened and the pedestrian passageway and thereby unblocked to permit ingress to the secured area.

The rotation of square shaft 66 may be controlled by the lock plate 69 illustrated in FIG. 3. Lock plate 69 may be disposed to prevent the rotation of knob hub 62 if it is desired to have a second lock operable to secure the secured area.

In the event that the square shaft 66 is operated after any other locking device effecting it has been unlocked, rotation of knob hub 62 and pivoting of drawbar cam 54 will act to withdraw latchbolt 58 and auxiliary bolt 60; however, the rotation of knob hub 62 will have no effect on drawbar cam 52. Even if drawbar cam 52 is rotated by virtue of any force exerted thereon, the lost motion connection existing between drawbar cam 52 and main cam 48 will prevent the transmission of any force to main cam 58 and linkage 94. Since no force will be transmitted to main cam 48 and linkage 94, no force will be exerted onto cable 88 and cable wheel 86 will remain unmoved. Accordingly, it will be seen that operation of an external knob or handle to cause the withdrawal of both latchbolt 58 and auxiliary bolt 60 will have no significant impact on the security of the secured area because deadbolt 106 will remain extended and secure the pedestrian passageway until the combination lock/deadbolt 85 is independently operated.

Should deadbolt 106 be withdrawn and thus unlocked, the cable 88 will be either slack about hub 92 or buckled and the operation of the panic-bar device 10 will have no effect on the combination lock/deadbolt 85.

A significant advantage of this invention is that it serves to modify existing apparatuses such as the NT Monarch Push-Bar Series 18 Exit Devices and the Mas-Hamilton CDX-07 combination lock/deadbolt assembly with a minimum of parts and a minimum of modifications.

As one will appreciate, the entire apparatus may be enclosed within decorative covers which will inhibit access to the mechanical linkages described herein. However, these covers will have no effect on the operation of the combined assemblies.

This invention may be implemented for use on opposite swing doors by using a linkage which is a reversal of the linkage 94 and a relocation of the attachment point of the cable wheel 86 for screw 90 to provide the degree of wrap of cable 88 about hub 92.

One of ordinary skill in the art will appreciate that modifications and changes may be made to mechanisms described herein while still producing an assembly which will function as described and still remain within the scope of the attached claims. Some of the modifications which may be made could include forming the main cam 48 and linkage 94 as a single member and/or replacing the square shaft 66 used for entry from outside the secured area with a thumb lever. Such changes and modifications may be implemented as desirable.

We claim:

1. A pedestrian door push-to-exit control for controlling ingress to a secure area while permitting unrestricted egress through said door, comprising:

a combination lock having a lock bolt, said lock bolt having an extended and a retracted position;

a deadbolt having an extended position and a withdrawn position associated with said combination lock and having a deadbolt, said deadbolt connected by a lost motion connection with said lock bolt, permitting withdrawal of said deadbolt from said extended position without movement of said lock bolt;

a rotatable control associated with said deadbolt to withdraw said deadbolt from said extended position to said withdrawn position;

said combination lock operable to withdraw said deadbolt upon operation of said combination lock to withdraw said lock bolt;

a push-to-exit device for normally maintaining said door in a locked and secured condition from the exterior of said door, said push-to-exit device comprising:

a chassis;

a latchbolt, supported on said chassis, biased to an extended position;

a drawbar connected to said latchbolt;

a pair of drawbar cams pivoted on said chassis and engaging said drawbar;

a manually operable control, manipulable from outside said door and drivingly engagable with a first one of said drawbar cams;

a push bar mechanism mounted on an interior face of said door;

a pair of main cams, each pivoted on said chassis and drivingly engaged with said drawbar cams in one direction of movement of said main cams and disengagable in an opposite direction of movement;

a cam connector driven by said push bar mechanism in a withdrawing direction relative to said latchbolt and engaged with said main cams;

a bellcrank pivoted coaxially with a second one of said drawbar cams and one of said main cams and connected to said one of said main cams for movement with said one of said main cams;

a lost motion connection between said bellcrank and said rotatable control, drivingly connecting said bellcrank and said rotatable control in a direction for effecting withdrawal of said deadbolt and absorbing movement of said rotatable control resulting from operation of said combination lock, whereby operation of said push-to-exit device will effect withdrawal of said latchbolt and simultaneous rotation of said rotatable control to effect withdrawal of said deadbolt, while operation of said manually operable control to withdraw said latchbolt will not effect the withdrawal of said deadbolt.

2. The pedestrian door push-to-exit control of claim 1 wherein said lost motion connection between said bellcrank and said rotatable control comprises a flexible cable attached to and at least partially wrapped around said rotatable control and fixedly attached to said bellcrank.

3. The pedestrian door push-to-exit control of claim 2 wherein said lost motion connection between said bellcrank and said rotatable control comprises a threaded termination on one end of said cable, said termination insertable into and rigidly attachable to said bellcrank.

4. The pedestrian door push-to-exit control of claim 1 wherein said bellcrank and one of said main cams are formed integrally.

5. The pedestrian door push-to-exit control of claim 1 wherein said bellcrank and one of said main cams are connected by a pin attached to said main cam and extending through a hole in said bellcrank.

* * * * *